US007132626B2

(12) United States Patent
Higgins et al.

(10) Patent No.: US 7,132,626 B2
(45) Date of Patent: Nov. 7, 2006

(54) RADIANT ELECTRIC HEATER

(75) Inventors: George Anthony Higgins, Clifton-upon-Teme (GB); Stuart Lamb, Redditch (GB)

(73) Assignee: Ceramaspeed Limited (GB)

( * ) Notice: Subject to any disclaimer, the term of this patent is extended or adjusted under 35 U.S.C. 154(b) by 188 days.

(21) Appl. No.: 10/626,663

(22) Filed: Jul. 22, 2003

(65) Prior Publication Data

US 2005/0061796 A1 Mar. 24, 2005

(30) Foreign Application Priority Data

Jul. 25, 2002 (GB) ..... 0217351

(51) Int. Cl.
*H05B 3/68* (2006.01)

(52) U.S. Cl. ..... 219/460.1; 219/458.1

(58) Field of Classification Search ..... 219/458.1, 219/459.1, 460.1, 461.1, 462.1, 141; 338/283, 338/279, 280

See application file for complete search history.

(56) References Cited

U.S. PATENT DOCUMENTS 2,330,867 A * 10/1943 Challet ..... 219/458.1
4,511,789 A * 4/1985 Goessler et al. ..... 219/448.11
5,393,958 A * 2/1995 Gross et al. ..... 219/461.1
5,892,206 A * 4/1999 Higgins ..... 219/457.1
5,977,523 A * 11/1999 Scott ..... 219/447.1

FOREIGN PATENT DOCUMENTS

GB 2322272 8/1988
GB 2193617 10/1988

OTHER PUBLICATIONS

United Kingdom Search Report Jan. 17, 2003.

* cited by examiner

*Primary Examiner*—Sang Paik
(74) *Attorney, Agent, or Firm*—Ira S. Dorman

(57) ABSTRACT

A radiant electric heater includes at least first (7) and second (11) adjacent heating zones. The first heating zone (7) includes a first heating element portion (5) and the second heating zone includes a second heating element portion (9). An electrical terminal (19) is provided at a periphery of the heater for connecting the first and second heating element portions to a source of electrical energy. The heating element portions (5, 9) are integral with conjoined ends connected to a first electrical connector (21), with one free end connected to a second electrical (23) connector, and with another free end connected to a third electrical connector (25). The first, second and third electrical connectors include means for connecting to the heating element portions in such a way that the heating element portions are not deflected from their intended path to any substantial extent.

23 Claims, 6 Drawing Sheets

21
25
19
23
35
37
39
41

45
35
43

RADIANT ELECTRIC HEATER

This invention relates to a radiant electric heater and in particular relates to a radiant electric heater, for example for a glass ceramic cooking appliance, comprising at least first and second adjacent heating zones.

DESCRIPTION OF PRIOR ART

It is known to manufacture radiant electric heaters for glass ceramic top cooking appliances which are provided with two heating zones in the form of an inner, circular, heating zone and an outer, annular, heating zone extending around the inner zone. The inner and outer heating zones may, or may not, be separated by a dividing wall of thermal insulating material so as to define if desired separate and distinct heating zones on the glass ceramic cooking surface. The inner and outer heating zones are each constituted by a heating element in the form of a ribbon or coil material which is configured to occupy the space allotted to the heating zone concerned and which is supported on a base of thermal insulating material provided in a supporting dish. Thus, a first heating element is provided in the inner heating zone and a second heating element is provided in the outer heating zone. A probe-type temperature sensor or other suitable type of temperature sensor extends over the outer and inner heating zones and is adapted to be responsive in particular to the temperature of the glass ceramic cooking surface in the region of the inner heating zone. The heating elements are connected to the temperature sensor and to a source of electrical power by way of a terminal block provided in a peripheral wall of the supporting dish. The terminal block is provided adjacent to the temperature sensor and is formed with three electrical connectors which extend substantially radially relative to the supporting dish, a first connector adjacent to the temperature sensor, a second connector remote from the temperature sensor and a third connector intermediate the first and second connectors. It is common practice in such known heaters to connect the first connector externally of the supporting dish directly to an electrical connector of the temperature sensor, for example by means of welding, and internally of the dish to one end of each of the first and second heating elements. It is also common practice to connect the other end of the second heating element to the second connector within the dish and to connect the other end of the first heating element to the third connector within the dish, the connection between the end of the first heating element and the third connector being by way of a link which is secured at one end to the end of the first heating element, passes over the end of the second heating element, and is connected to, or integral with, the third connector.

Disadvantages of such known radiant electric heaters are that the presence of two separate heating elements and the manner in which the heating elements are secured to the electrical connectors render the insertion of the heating elements unsuitable for automatic production methods.

Similar problems can arise with oval radiant electric heaters in which a second heating element is provided adjacent to a first heating element, the first heating element being provided in a circular heating zone and the second heating element being provided in a part-circular, substantially arcuate (or crescent shaped) heating zone.

OBJECT OF THE INVENTION

It is therefore an object of the present invention to provide a radiant electric heater which overcomes or at least ameliorates the above disadvantages.

SUMMARY OF THE INVENTION

According to the present invention there is provided a radiant electric heater comprising at least first and second adjacent heating zones, the first heating zone including a first heating element portion and the second heating zone including a second heating element portion, and terminal means provided at a periphery of the heater for connecting the first and second heating element portions to a source of electrical energy, wherein the heating element portions are integral with conjoined ends connected to a first electrical connector, with one free end connected to a second electrical connector, and with another free end connected to a third electrical connector, the first, second and third electrical connectors including means for connecting to the heating element portions in such a way that the heating element portions are not deflected from their intended path to any substantial extent.

The heating element portions may be in the form of a ribbon inserted upright into a base of thermal and electrical insulating material.

The heating element portions may form a heating element in the form of a double spiral, a first strand of the double spiral extending from a peripheral region of the heater to a central region thereof and a second strand of the double spiral extending from the central region to the peripheral region thereof.

The first heating zone may be circular. In such a case, the second heating zone may be annular and may surround the first heating zone or the second heating zone may be part-circular and may partially surround the first heating zone.

A peripheral wall may be provided around the external periphery of the heater.

A dividing wall may be provided between the adjacent heating zones.

A temperature limiter may be provided for sensing the temperature in the region of at least the first heating zone.

The third electrical connector may be positioned intermediate the first and second electrical connectors.

In such a case, a radially inner region of each of the first and second electrical connectors may extend generally circumferentially of the heater in a direction away from the terminal block. The radially inner region of the first electrical connector may extend at an angle in a range from 70 degrees to 90 degrees, for example substantially at 80 degrees, to a portion thereof passing through the terminal block. The radially inner portion of the second electrical connector may extend at an angle in a range from 30 degrees to 60 degrees, for example substantially at 45 degrees, to a portion thereof passing through the terminal block.

A radially inner region of the third electrical connector may extend generally circumferentially of the heater in a direction towards one of the first and second electrical connectors. The radially inner portion of the third electrical connector may include a link element which passes across the region of the conjoined ends of the first and second heating element portions. The link element may pass over the region of the conjoined ends of the first and second heating element portions. Alternatively, the link element may pass under the region of the conjoined ends of the first and second heating element portions. The radially inner portion of the second electrical connector may extend at an angle in a range from 30 degrees to 60 degrees, for example substantially at 45 degrees, to a portion thereof passing through the terminal block.

Two second heating element portions may be provided, the two portions being electrically connected in parallel. A conducting link may be provided between the first electrical connector and the first and second strands of the double spiral in the region of the junction between the first and second heating zones. A further conducting link may be provided between the third electrical connector and the first strand of the double spiral in the region of the junction between the first and second heating zones. The first strand may be severed between the first-mentioned and further conducting links.

Alternatively, a radially inner region of the second electrical connector may extend generally circumferentially of the heater in a direction away from the terminal block. The radially inner portion of the second electrical connector may extend at an angle in a range from 30 degrees to 60 degrees, for example substantially at 45 degrees, to a portion thereof passing through the terminal block. The radially inner portion of the third electrical connector may include a link element which passes across the second heating element portion. The radially inner portion of the first electrical connector may include a link element which passes across the second heating element portion.

In an alternative embodiment, the first electrical connector is positioned intermediate the second and third electrical connectors. A radially inner region of each of the second and third electrical connectors may extend generally circumferentially of the heater in a direction away from the terminal block. The radially inner portion of the second electrical connector may extend at an angle in a range from 30 degrees to 60 degrees, for example substantially at 45 degrees, to a portion thereof passing through the terminal block. The radially inner portion of the third electrical connector may extend at an angle in a range from 30 degrees to 60 degrees, for example substantially at 45 degrees, to a portion thereof passing through the terminal block. A radially inner region of the first electrical connector may extend generally circumferentially of the heater in a direction towards one of the second and third electrical connectors. The radially inner region of the first electrical connector may extend at an angle in a range from 70 degrees to 90 degrees, for example substantially at 80 degrees, to a portion thereof passing through the terminal block.

For a better understanding of the present invention and to show more clearly how it may be carried into effect reference will now be made, by way of example, to the accompanying drawings in which:

DESCRIPTION OF PREFERRED EMBODIMENTS

Figure 1:
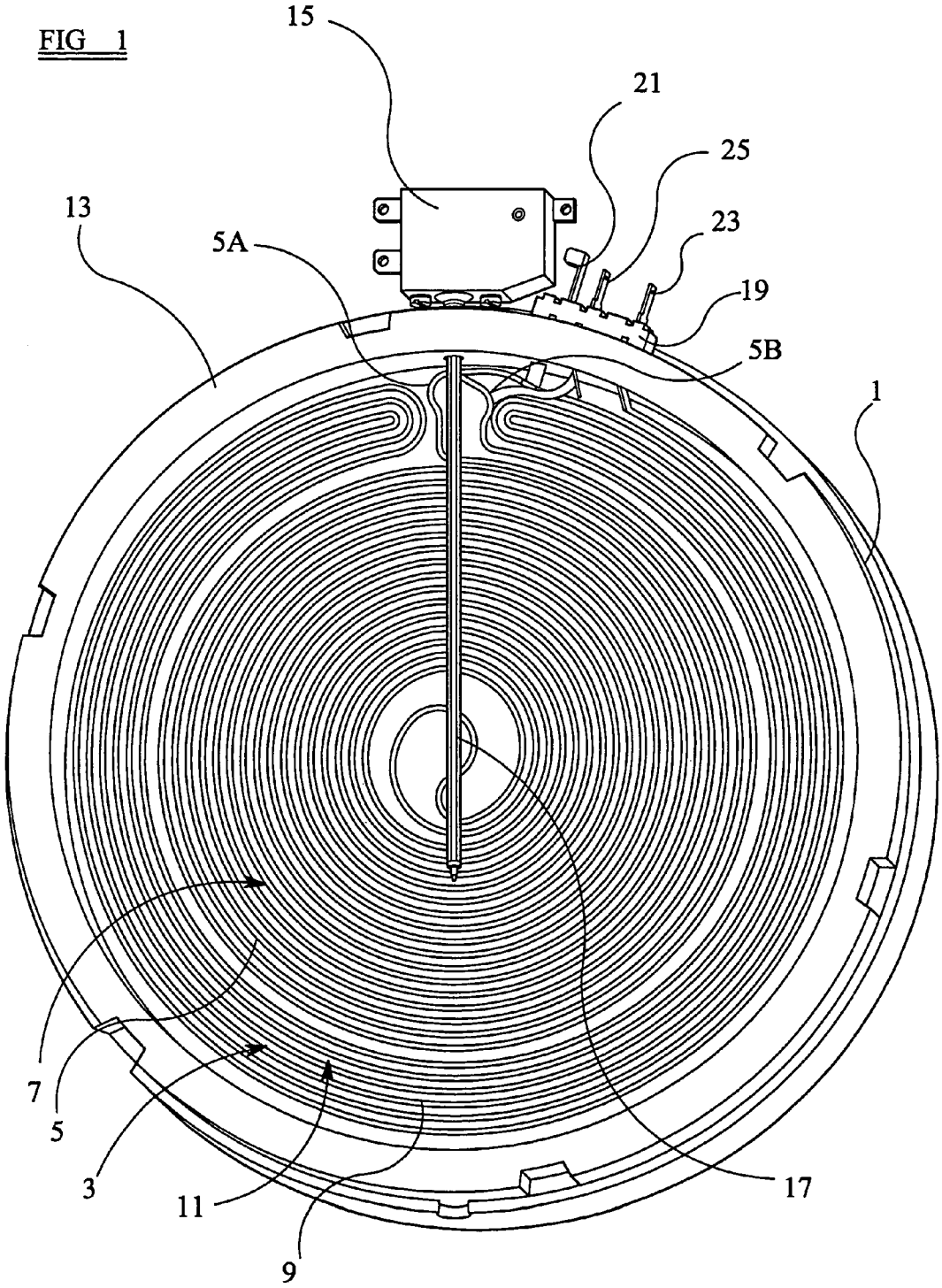
FIG. 1 is a perspective view, from above, of one embodiment of a radiant electric heater according to the present invention.
Figure 2:
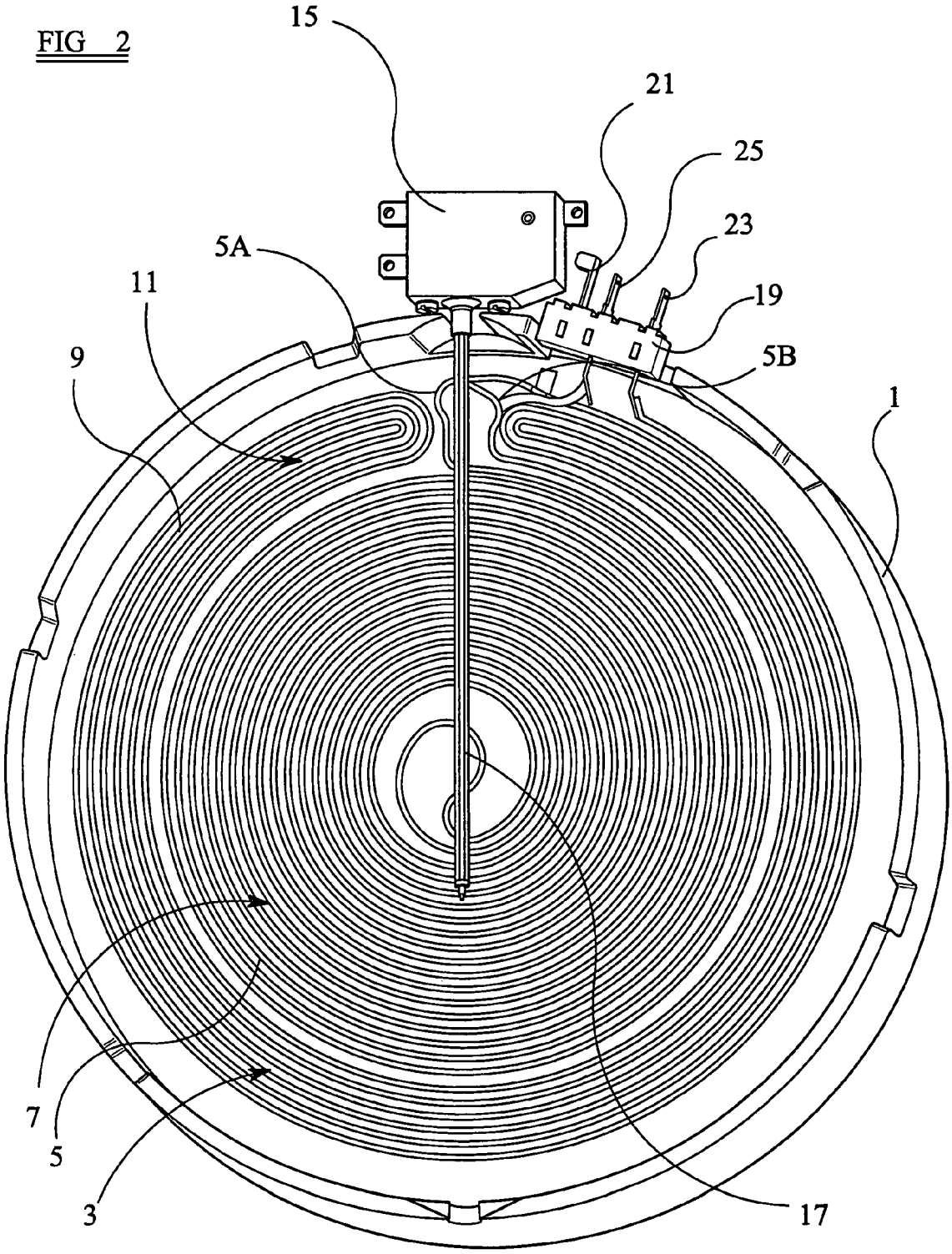
FIG. 2 is a view similar to that of FIG. 1 with a peripheral wall of the radiant electric heater removed.
Figure 3:
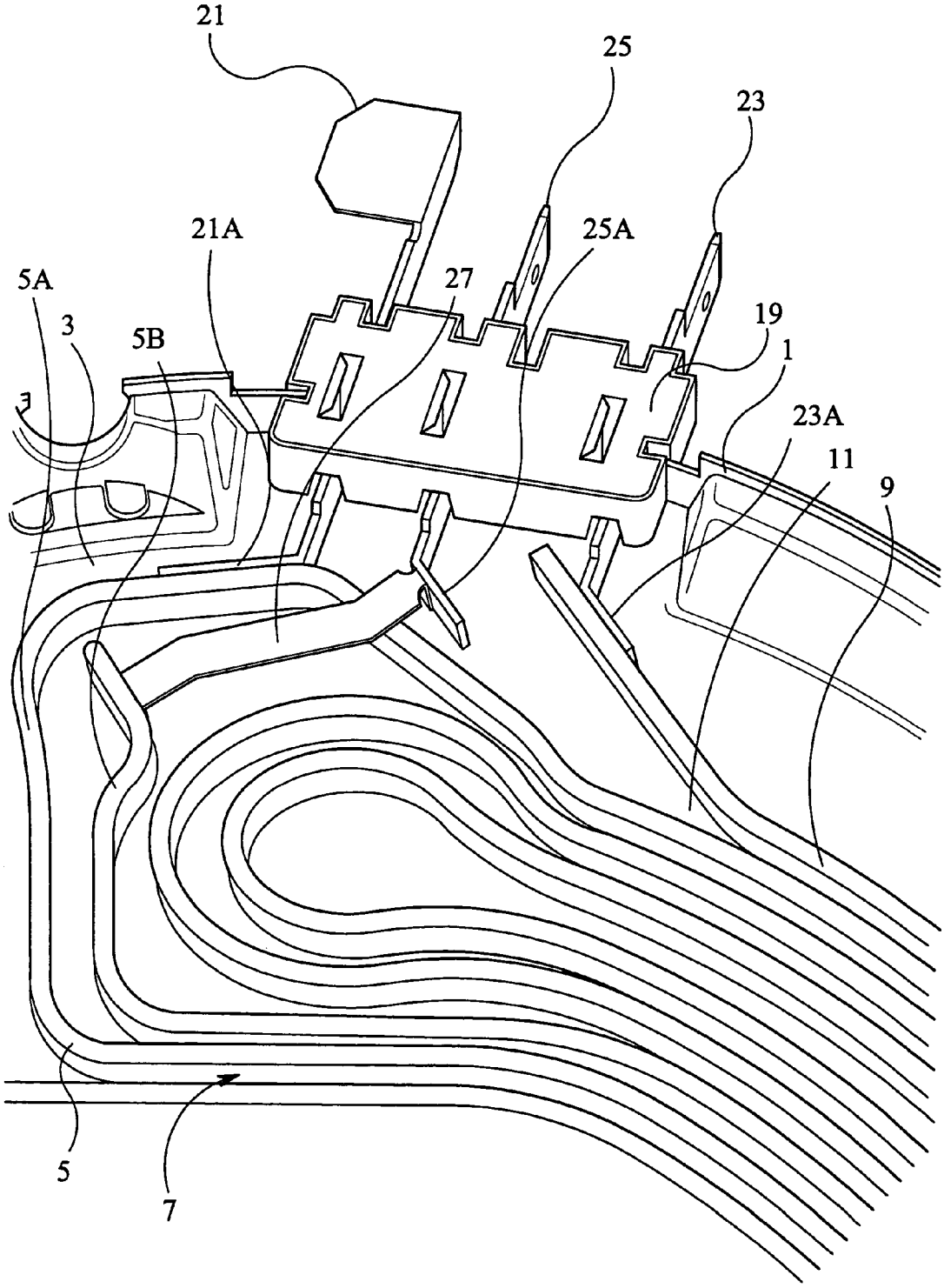
FIG. 3 is a view, on a larger scale, of part of the radiant electric heater shown in FIG. 2, but with a temperature limiter of the radiant electric heater additionally removed.

The radiant electric heater shown in. FIGS. 1 to 3 comprises a supporting dish 1, for example of metal, containing a base 3 of thermal and electrical insulating material, for example compressed microporous thermal and electrical insulating material. Secured to the base 3 is a first heating element portion 5 of ribbon form material inserted upright into the base, the first heating element portion 5 occupying a substantially circular inner heating zone 7 in the central region of the heater. Also secured to the base 3 is a second heating element portion 9 of ribbon form material inserted upright into the base, the second heating element portion 9 occupying a substantially annular outer heating zone 11 around the peripheral region of the heater. The first and second heating element portions are each part of an integral heating element and each portion has a free end and a conjoined end integral with a conjoined end of the other heating element portion.

In practice, the first heating element portion 5 is arranged to be energised whenever the heater is energised irrespective of the size of the cooking utensil placed on a glass ceramic cooking surface (not shown) below which the heater is arranged, while the second heating element portion 9 is only energised (in conjunction with the first heating element portion) when a relatively large cooking utensil is used such that the cooking utensil overlies both the first and second heating element portions.

A peripheral wall 13 of thermal insulating material extends around the periphery of the heater between the outer heating zone 11 and an upstanding wall of the supporting dish 1.

A probe-type temperature limiter 15 extends from a periphery of the heater, a temperature sensor 17 of the limiter 15 extending substantially over the first heating element portion 5 in the inner heating zone 7. As shown in FIGS. 1 to 3, the end regions 5A and 5B of the first heating element portion 5 extend beneath the temperature sensor 17 where the temperature sensor crosses the outer heating zone 11 in order to reduce as far as practicable the effect of the second heating element portion on the temperature sensed by the temperature sensor 17 and to minimise as far as practicable the change in the temperature of the glass ceramic cooking surface resulting from when only the first heating element portion or both the first and second heating element portions are energised.

A terminal block 19 is mounted on the upstanding wall of the supporting dish 1 adjacent to the temperature limiter 15 and is provided with a first electrical connector 21 adjacent to the temperature limiter, a second electrical connector 23 remote from the temperature limiter and with a third electrical connector 25 intermediate the first and second electrical connectors.

Externally of the supporting dish 1, the first electrical connector 21 is connected directly, for example by welding, to an electrical connector of the temperature limiter 15.

Internally of the supporting dish 1 and the peripheral wall 13, the first electrical connector 21 is bent so as to extend substantially parallel to the circumference of the heater in a direction towards the temperature limiter 15, that is in a direction away from the terminal block 19. For example, the internal portion 21A of the first electrical connector 21 may be bent at an angle of substantially 80 degrees to that part of the connector which passes through the terminal block. Such a substantially circumferential arrangement of the internal portion 21A of the first electrical connector 21 allows the conjoined ends of the first heating element portion 5 and the second heating element portion 9 to be arranged adjacent and substantially parallel to a radially inner face of the portion 21A. Such an arrangement allows the end portions of the first and second heating element portions to be integral as described above and to be secured to the portion 21A of the first electrical connector 21, for example by means of welding, so as to form a common connection for the conjoined ends of the first and second heating element portions. Thus, as indicated above, the first and second heating element portions may be integral and may be a single heating element. Thus, only a single heating element needs to be inserted into the base 3 thereby facilitating automatic insertion of the heating element portions by "winding in" the heating element portions from the free end of the first heating element portion remote from the conjoined ends of the first and second heating element portions to the free end of the second heating element portion also remote from the conjoined ends. Further, in the region where the conjoined ends of the first and second heating element portions are secured to the portion 21A of the first electrical connector 21, the conjoined ends are able to extend substantially circumferentially and do not need to be deflected to any substantial extent from their intended path, thereby avoiding small radius bends and further facilitating automatic insertion of the integral first and second heating element portions.

Internally of the supporting dish 1 and the peripheral wall 13, the second electrical connector 23 is bent so as to be angled generally circumferentially of the heater in a direction away from the temperature limiter 15, that is in a direction away from the terminal block 19. For example, the internal portion 23A of the second electrical connector may be bent at an angle of substantially 45 degrees to that part of the connector which passes through the terminal block 19. Such an angled arrangement of the internal portion 23A of the second electrical connector 23 allows the free end of the second heating element portion 9 to be arranged adjacent and substantially parallel to a radially inner face of the portion 23A. Such an arrangement allows the free end portion of the second heating element portion 9 to be secured to the portion 23A of the second electrical connector 23, for example by means of welding, so as to form a second connection for the second heating element portion 9 without the need for the heating element to be deflected to any substantial extent from its intended path.

Internally of the supporting dish 1 and the peripheral wall 13, the third electrical connector 25 is bent so as to be angled generally circumferentially of the heater in a direction away from the temperature limiter 15, that is in a direction towards the second electrical connector 23. For example, the internal portion 25A of the third electrical connector may be bent at an angle of substantially 45 degrees to that part of the connector which passes through the terminal block 19. Such an angled arrangement of the internal portion 25A of the third electrical connector 25 allows the third electrical connector to include a link element 27 to be secured to, or formed integral with, the remainder of the internal portion 25A of the third electrical connector 25, the link element extending substantially at right angles to the remainder of the portion 25A and having a generally U-shaped configuration so as to extend over (or under) the conjoined ends of the first and second heating element portions and to allow the free end of the first heating element portion 5 to be arranged adjacent and substantially parallel to a radially inner substantially upright face of the link element 27 which extends generally circumferentially of the heater. Such an arrangement allows the free end portion of the first heating element portion 5 to be secured to the link element 27, for example by means of welding, and thus to the remainder of the portion 25A of the third electrical connector 25 so as to form a second connection for the first heating element portion 5 without the need for the heating element to be deflected to any substantial extent from its intended path.

As can be seen from FIGS. 1 to 3, the internal portions of the electrical connectors at each circumferential end of the terminal block 19 extend generally circumferentially away from the terminal block, while the internal portion of the intermediate electrical connector may extend generally circumferentially towards whichever of the other two electrical connectors is most convenient. Such an arrangement allows the integral first and second heating element portions to be inserted into the base while providing gentle bends with relatively large radii in the regions of the electrical connectors such that the heating elements do not need to be deflected to any substantial extent from their intended path.

Thus, the heating element portions may be inserted into the base 3 of the radiant electric heater shown in FIGS. 1 to 3 by starting at a free end of one of the heating element portions and continuing until the free end of the other heating element portion is reached. In this way, both heating element portions can be inserted into the base in a single operation, the gentle bends, particularly in the regions of the internal portions of the connectors, facilitating automatic insertion and the arrangements of the internal portions facilitating securement of the heating element portions to the internal portions of the connectors.

In use of the radiant electric-heater shown in FIGS. 1 to 3, either the first heating element portion 5 can be energised alone, or the first and second heating element portions 5 and 9 can be energised in parallel.

The radiant electric heater shown in FIGS. 1 to 3 can be modified in a number of respects. For example, the radiant electric heater need not be circular, but could be, for example, oval in configuration with the first heating element portion 5 occupying a substantially circular heating zone 7 and the second heating element portion 9 occupying a part-circular (or crescent shaped) heating zone 11 adjacent to the circular heating zone 7.

Moreover, although the two heating zones are shown in FIGS. 1 to 3 as being undivided, if desired a dividing wall may be provided in a manner well known to the skilled person between the two heating zones so as to define on the glass ceramic cooking surface separate and distinct heating areas corresponding to the two heating zones.

Should it not be necessary to provide the first electrical connector at one end of the terminal block 19 for direct connection to the temperature limiter 15, and providing there is adequate space along the circumferential length of the terminal block, the first electrical connector for the conjoined ends of the integral first and second heating element portions may be provided intermediate the second and third electrical connectors, with the internal portion of the first electrical connector extending in a generally circumferential direction towards whichever of the other two electrical connectors is most convenient. Such an arrangement has the advantage that the link 27 is no longer required and the free end of the first heating element portion can be secured directly to the internal portion of the third electrical connector, such internal portion being bent in a direction generally circumferentially of the heater away from the terminal block 19, for example at an angle of about 45 degrees to that part of the third electrical connector which passes through the terminal block, to allow the free end of the first heating element portion 5 to be arranged adjacent and substantially parallel to a radially inner face of the portion 25A. Such an arrangement allows the free end portion of the first heating element portion to be secured to the portion 25A of the third electrical connector 25, for example by means of welding, so as to form a second connection for the first heating element portion 5.

Thus, the internal portions of the electrical connectors at each circumferential end of the terminal block 19 extend generally circumferentially away from the terminal block, while the internal portion of the intermediate electrical connector may extend generally circumferentially towards whichever of the other two electrical connectors is most convenient.

Where the radiant electric heater in FIGS. 1 to 3 shows the internal portion 21A of the first electrical connector 21 angled in a direction opposite to the internal portion 23A of the second electrical connector 23 it should be appreciated that all the internal portions 21A, 23A and 25A could be angled in the same direction relative to the terminal block 19. In which case the internal portion 21A of the first electrical connector 21 would be bent at an angle in the range from 30 degrees to 60 degrees, for example substantially at 45 degrees, to that part of the connector which passes through the terminal block.

Figure 4:
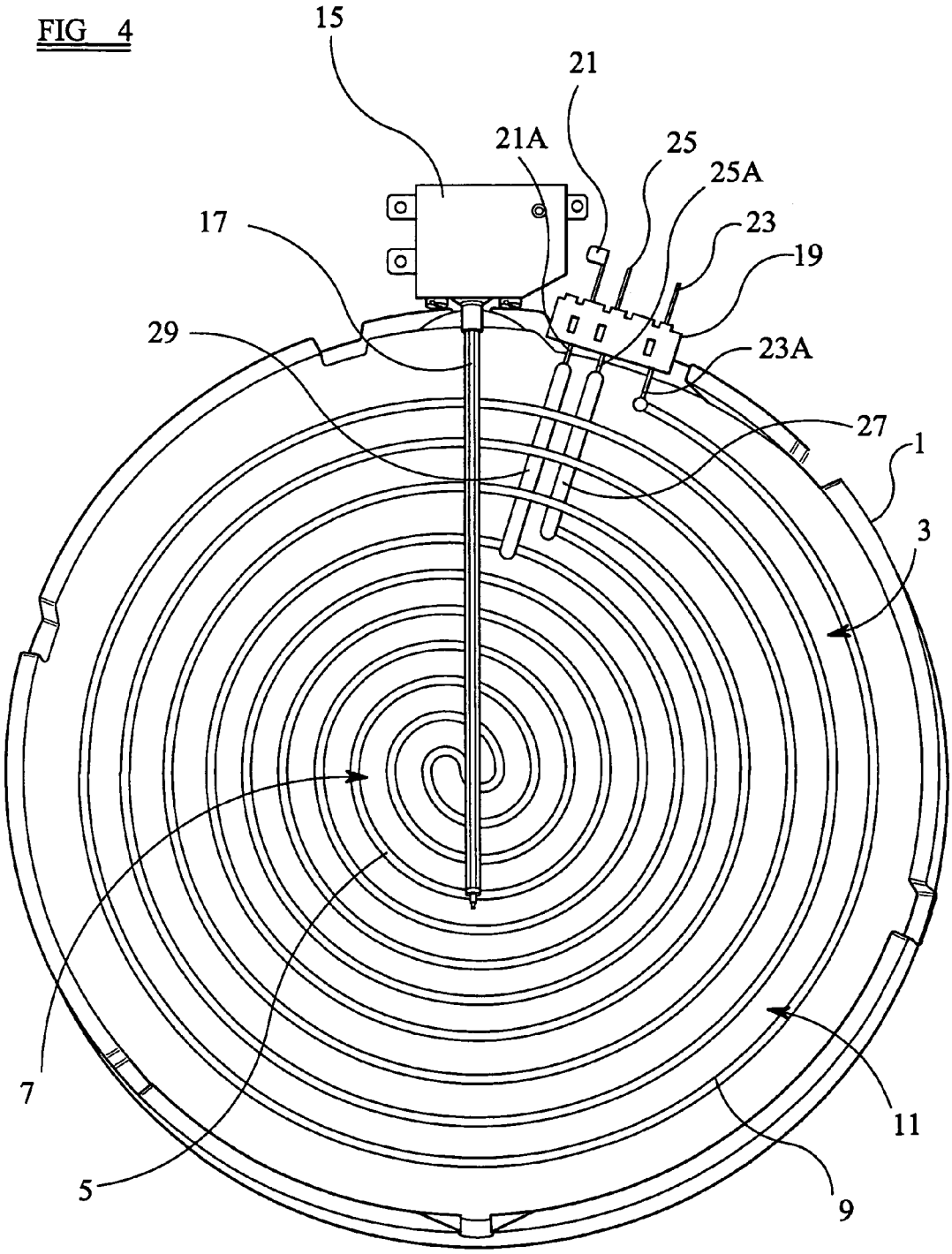
FIG. 4 is a plan view of another embodiment of a radiant electric heater according to the present invention.

The radiant electric heater shown in FIG. 4 is similar to that shown in FIGS. 1 to 3 and the same reference numerals are used to denote the same or similar components. The radiant electric heater of FIG. 4 is shown with the peripheral wall 13 omitted, but with the temperature limiter 15 present.

As can be seen from FIG. 4, the second heating element portion 9 is wound in from the periphery of the outer heating zone 11 to the junction between the outer and inner heating zones. The integral first heating element portion 5 is then wound in from the periphery of the inner heating zone 7 to the region of the centre of the heater and is then wound in from the region of the centre of the heater back to the periphery of the inner heating zone 7.

The free end of the second heating element portion 9 is connected to the internal portion 23A of the second electrical terminal 23 of the terminal block 19, the internal portion 23A being bent so as to be angled in a direction generally circumferentially of the heater away from the temperature limiter 15, that is in a direction away from the terminal block 19. For example, the internal portion 23A of the second electrical connector may be bent at an angle of substantially 45 degrees to that part of the connector which passes through the terminal block. Such an angled arrangement of the internal portion 23A of the second electrical connector 23 allows the free end of the second heating element portion 9 to be arranged adjacent and substantially parallel to a radially inner face of the portion 23A. Such an arrangement allows the end portion of the second heating element portion to be secured to the portion 23A of the second electrical connector 23, for example by means of welding, so as to form a connection for the second heating element portion 9 without the need for the heating element to be deflected to any substantial extent from its intended path.

The third electrical connector 25 includes link element 27 between the free end of the first heating element portion 5 and the remainder of the internal portion 25A of the third electrical connector 25 and extending over (or under) the second heating element portion 9. In the embodiment of FIG. 4 it is not necessary for the internal portion of the third electrical connector to be bent relative to that part which passes through the terminal block. However, the radially inner end of the link element 27 is formed with a generally circumferential upright face to allow the free end portion of the first heating element portion 5 to be secured to the link element 27, for example by means of welding, and thus to the remainder of the portion 25A of the third electrical connector 25 so as to form a connection for the first heating element portion 5 without the need for the free end of the first heating element portion to be deflected to any substantial extent from its intended path.

The first electrical connector 21 includes a further link element 29 provided between the conjoined ends of the integral first and second heating element portions and the remainder of the internal portion 21A of the first electrical connector 21 and extending over (or under) the second heating element portion 9. As with the third electrical connector 25, it is not necessary for the internal portion of the electrical connector to be bent relative to that part which passes through the terminal block 19. However, the radially inner end of the further link element 29 is formed with a generally circumferential upright face to allow the conjoined end portions of the first and second heating element portions to be secured to the further link element 29, for example by means of welding, and thus to the remainder of the portion 21A of the first electrical connector 21 so as to form a connection for the conjoined ends of the first and second heating element portions 5 and 9 without the need for the conjoined ends of the first and second heating element portions to be deflected to any substantial extent from their intended path.

If desired, the temperature sensor 17 of the temperature limiter 15 can be rendered insensitive to heat emitted by the second heating element in any one of a number of ways well known to the skilled person.

If desired, the radiant electric heater of FIG. 4 may be modified to provide more than two heating zones, each heating zone having a heating element portion. In such a case, the terminal block requires an electrical connector for each of the two free ends and an electrical connector for each of the conjoined ends between successive heating element portions. Thus, a radiant electric heater with three heating zones will require a terminal block with four electrical connectors, one for each of the free ends, one for a connection between the first and second zones and one for a connection between the second and third zones.

Figure 5:
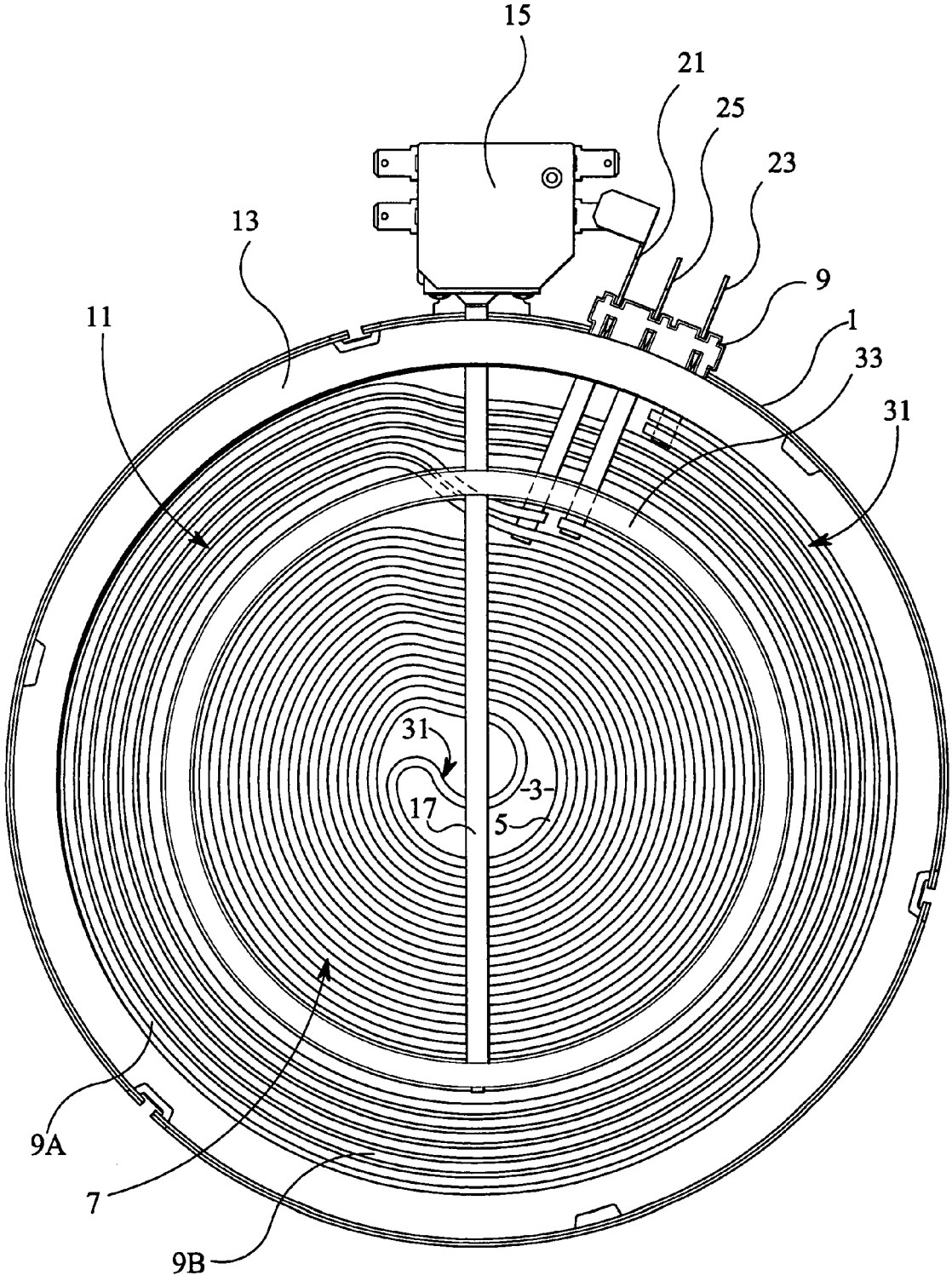
FIG. 5 is a plan view of a further embodiment of a radiant electric heater according to the present invention.
Figures 6, 7:
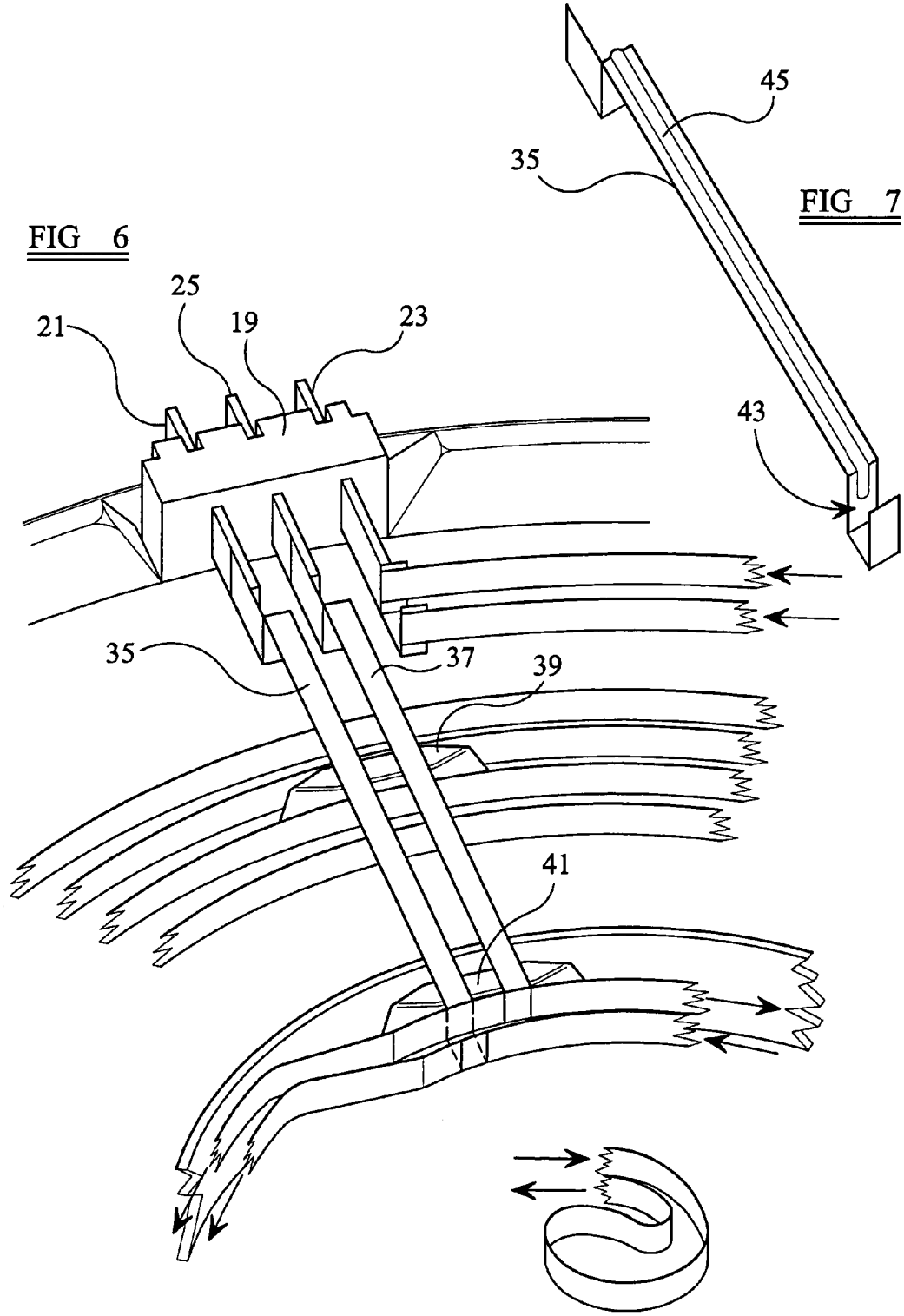
FIG. 6 is a partial perspective view of the radiant electric heater shown in FIG. 5.
FIG. 7 is a perspective view of a conducting link forming part of the radiant electric heater shown in FIGS. 5 and 6.

The radiant electric heater shown in FIGS. 5 to 7 is similar to that shown in FIG. 4 and the same reference numerals are used to denote the same or similar components.

In the embodiment of FIGS. 5 to 7 a single heating element 31 of ribbon form is inserted into the base 3 in a double spiral pattern beginning from a first end in the peripheral region of the heater and reversing in the region of the centre of the heater and returning to the peripheral region of the heater where the heating element terminates in a second end. Thus, the single heating element has both incoming and outgoing strands. The first and second ends are both secured to the first electrical connector 21.

A dividing wall 33 of thermal and electrical insulating material is positioned within the heater 1 to divide the heated area into a central, substantially circular zone 7 and an outer, substantially annular zone 11.

A conducting link 35 extends between the first electrical conductor 21 and both the incoming and outgoing strands of the heating element 31 in the region of the junction between the first and second heating zones.

A conducting link 37 extends between the third electrical conductor 25 and the incoming strand of the heating element 31 in the region of the junction between the first and second heating zones, while the incoming strand is severed between the conducting links 35 and 37 so as to electrically isolate the portions of the incoming strand at the conducting links 35 and 37. There is therefore a single first heating element portion 5 within the central zone 7 formed by the incoming strand extending from the conducting link 37 extending from the third electrical conductor 25 and by the outgoing strand extending to the conducting link 35 extending from the first electrical conductor 21.

In this way, the incoming and outgoing strands in the outer substantially annular zone are electrically connected in parallel to form two second heating element portions 9A and 9B, while conjoined ends of the first and second heating element portions are locate at the radially inner end of the conducting link 35.

Thus, the conducting link 35 forms a connection for the conjoined ends of the first and second heating element portions without the need for the conjoined ends to be deflected to any substantial extent from their intended path.

Using the parallel electrical connection in the outer zone, it is possible to generate a higher power density in the outer zone than in the central zone, which is considered desirable in such radiant electrical heaters.

FIG. 6 shows the arrangement of the conducting links 35 and 37 in more detail. As can be seen from FIG. 6, the conducting links may be supported on one or more raised regions of the base 3, one raised region 39 being provided approximately mid-way between the peripheral wall 13 and the dividing wall 33 and another raised region 41 being provided substantially coincident with the dividing wall 33, for example in a cut out region of the dividing wall.

FIG. 7 shows the conducting link 35 as being of arched configuration (as is the conducting link 37) and having a substantially U-shaped portion 43 at its radially inner end in order that the incoming and outgoing strands of the heating element 31 can be electrically connected to separate legs of the U-shaped portion. For strength, the surface of the arched region of the conducting link may be formed with a reinforcing rib 45.

We claim:

1. A radiant electric heater comprising at least first and second adjacent heating zones, the first heating zone including a first heating element portion and the second heating zone including a second heating element portion, and terminal means provided at a periphery of the heater for connecting the first and second heating element portions to a source of electrical energy and including first, second and third electrical connectors, the third electrical connector being positioned intermediate the first and second electrical connectors and a radially inner region of each of the first and second electrical connectors extending generally circumferentially of the heater in a direction away from the terminal block, wherein the heating element portions are integral with conjoined ends connected to the first electrical connector, with one free end connected to the second electrical connector, and with another free end connected to the third electrical connector, the first, second and third electrical connectors including means for connecting to the heating element portions in such a way that the heating element portions are not deflected from their intended path to any substantial extent.

2. A heater as claimed in claim 1, wherein the radially inner region of the first electrical connector extends substantially at 80 degrees to a portion thereof passing through the terminal block.

3. A heater as claimed in claim 1, wherein the radially inner portion of the second electrical connector extends substantially at 45 degrees to a portion thereof passing through the terminal block.

4. A heater as claimed in claim 1, wherein a radially inner region of the third electrical connector extends generally circumferentially of the heater in a direction towards one of the first and second electrical connectors.

5. A heater as claimed in claim 4, wherein the radially inner portion of the third electrical connector includes a link element which passes across the region of the conjoined ends of the first and second heating element portions.

6. A heater as claimed in claim 5, wherein the link element passes over the region of the conjoined ends of the first and second heating element portions.

7. A heater as claimed in claim 6, wherein the link element passes under the region of the conjoined ends of the first and second heating element portions.

8. A heater as claimed in claim 4, wherein the radially inner portion of the second electrical connector extends substantially at 45 degrees to a portion thereof passing through the terminal block.

9. A heater as claimed in claim 1, wherein a radially inner region of the second electrical connector extends generally circumferentially of the heater in a direction away from the terminal block.

10. A heater as claimed in claim 9, wherein the radially inner portion of the second electrical connector extends substantially at 45 degrees to a portion thereof passing through the terminal block.

11. A heater as claimed in claim 9, wherein the radially inner portion of the third electrical connector includes a link element which passes across the second heating element portion.

12. A heater as claimed in claim 9, wherein the radially inner portion of the first electrical connector includes a link element which passes across the second heating element portion.

13. A radiant electric heater comprising at least first and second adjacent heating zones, the first heating zone including a first heating element portion and the second heating zone including two second heating element portions electrically connected in parallel, the first and second heating element portions forming a heating element in the form of a double spiral, a first strand of the double spiral extending from a peripheral region of the heater to a central region thereof and a second strand of the double spiral extending from a central region to the peripheral region thereof, terminal means provided at a periphery of the heater for connecting the first and second heating element portions to a source of electrical energy, and wherein the heating element portions are integral with conjoined ends connected to a first electrical connector, with one free end connected to a second electrical connector, and with another free end connected to a third electrical connector, the first, second and third electrical connectors including means for connecting to the heating element portions in such a way that the heating element portions are not deflected from their intended path to any substantial extent, and wherein a conducting link is provided between the first electrical connector and the first and second strands of the double spiral in the region of a junction between the first and second heating zones.

14. A heater as claimed in claim 13, wherein a further conducting link is provided between the third electrical connector and the first strand of the double spiral in the region of the junction between the first and second heating zones.

15. A heater as claimed in claim 14, wherein the first strand is severed between the first-mentioned and further conduction links.

16. A radiant electric heater comprising at least first and second adjacent heating zones, the first heating zone including a first heating element portion and the second heating zone including a second heating element portion, and terminal means provided at a periphery of the heater for connecting the first and second heating element portions to a source of electrical energy and including first, second and third electrical connectors, the third electrical connector being positioned intermediate the first and second electrical connectors and a radially inner region of each of the second and third electrical connectors extending generally circumferentially of the heater in a direction away from the terminal block, wherein the heating element portions are integral with conjoined ends connected to the first electrical connector, with one free end connected to the second electrical connector, and with another free end connected to the third electrical connector, the first, second and third electrical connectors including means for connecting to the heating element portions in such a way that the heating element portions are not deflected from their intended path to any substantial extent.

17. A heater as claimed in claim 16, wherein the radially inner portion of the second electrical connector extends substantially at 45 degrees to a portion thereof passing through the terminal block.

18. A heater as claimed in claim 16, wherein the radially inner portion of the third electrical connector extends substantially at 45 degrees to a portion thereof passing through the terminal block.

19. A heater as claimed in claim 16, wherein a radially inner region of the first electrical connector extends generally circumferentially of the heater in a direction towards one of the second and third electrical connectors.

20. A heater as claimed in claim 19, wherein the radially inner region of the first electrical connector extends substantially at 80 degrees to a portion thereof passing through the terminal block.

21. A radiant electric heater having a circumference and comprising at least first and second adjacent heating zones, the first heating zone including a first heating element portion and the second heating zone including a second heating element portion, and terminal means provided at a periphery of the heater for connecting the first and second heating element portions to a source of electrical energy, wherein the heating element portions are integrally formed from a continuous heating element with conjoined ends connected to a first electrical connector, with one free end connected to a second electrical connector, and with another free end connected to a third electrical connector, the first, second and third electrical connectors including means for connecting to the heating element portions in such a way that the heating element portions extend generally circumferentially of the heater in the region of connection and are not deflected from their intended path to any substantial extent, the third electrical connector being positioned intermediate the first and second electrical connectors and a radially inner region of each of the first and second electrical connectors extending generally circumferentially of the heater in a direction away from the terminal block.

22. A radiant electric heater having a circumference and comprising at least first and second adjacent heating zones, the first heating zone including a first heating element portion and the second heating zone including a second heating element portion, and terminal means provided at a periphery of the heater for connecting the first and second heating element portions to a source of electrical energy, wherein the heating element portions are integrally formed from a continuous heating element with conjoined ends connected to a first electrical connector, with one free end connected to a second electrical connector, and with another free end connected to a third electrical connector, the first, second and third electrical connectors including means for connecting to the heating element portions in such a way that the heating element portions extend generally circumferentially of the heater in the region of connection and are not deflected from their intended path to any substantial extent, the arrangement being such that the heating element portions form a heating element in the form of a double spiral, a first strand of the double spiral extending from a peripheral region of the heater to a central region thereof and a second strand of the double spiral extending from a central region to the peripheral region thereof, the second heating element being formed in two element portions which are electrically connected in parallel, a conducting link being provided between the first electrical conductor and the first and second strands of the double spiral in the region of the junction between the first and second heating zones.

23. A radiant electric heater having a circumference and comprising at least first and second adjacent heating zones, the first heating zone including a first heating element portion and the second heating zone including a second heating element portion, and terminal means provided at a periphery of the heater for connecting the first and second heating element portions to a source of electrical energy, wherein the heating element portions are integrally formed from a continuous heating element with conjoined ends connected to a first electrical connector, with one free end connected to a second electrical connector, and with another free end connected to a third electrical connector, the first, second and third electrical connectors including means for connecting to the heating element portions in such a way that the heating element portions extend generally circumferentially of the heater in the region of connection and are not deflected from their intended path to any substantial extent, the first electrical connector being positioned intermediate the second and third electrical connectors and a radially inner region of each of the second and third electrical connectors extending generally circumferentially of the heater in a direction away from the terminal block.

* * * * *